United States Patent [19]

Gibas et al.

[11] 4,392,117

[45] Jul. 5, 1983

[54] SWITCHING MAGNET

[76] Inventors: Christoph Gibas, Neunkirchener Weg 5, 5908 Neunkirchen; Michael Müller, Zum Turm 1, 6683 Spiesen, Elversberg, both of Fed. Rep. of Germany

[21] Appl. No.: 281,387

[22] Filed: Jul. 8, 1981

[30] Foreign Application Priority Data

Jul. 15, 1980 [DE] Fed. Rep. of Germany ..... 3026725

[51] Int. Cl.[3] ..... H01F 3/00

[52] U.S. Cl. ..... 335/297; 336/234; 336/83

[58] Field of Search ..... 335/281, 296, 297; 336/83, 234

[56] References Cited

U.S. PATENT DOCUMENTS

| | | | |
|---|---|---|---|
| 461,135 | 10/1891 | Stanley, Jr. | 336/83 X |
| 1,282,086 | 10/1918 | Johannesen | 336/234 X |
| 1,644,729 | 10/1927 | Johannesen | 336/234 X |
| 2,434,096 | 1/1948 | Ayers et al. | 335/281 X |
| 3,636,488 | 1/1972 | Wiesner | 336/83 |
| 3,947,955 | 4/1976 | Thiessens et al. | 336/83 X |
| 4,315,232 | 2/1982 | Spoldi et al. | 336/83 X |

FOREIGN PATENT DOCUMENTS

| | | |
|---|---|---|
| 2618138 | 6/1977 | Fed. Rep. of Germany . |
| 2746567 | 7/1979 | Fed. Rep. of Germany . |

*Primary Examiner*—William M. Shoop

*Attorney, Agent, or Firm*—Roylance, Abrams, Berdo & Farley

[57] ABSTRACT

A magnetic structure including a coil and yoke includes a bobbin or spool having a coil wound thereon, the flanges at the ends of the bobbin having protruding ribs defining radially extending slots which receive the legs of bundles of U-shaped laminations. The outer corners of the laminations are beveled or chamfered and are retained in position by end plates which have inwardly protruding inclined surfaces positioned to engage the beveled corners, thereby preventing outward radial movement of the laminations. The end plates can then be retained in place by conventional fastener means. The entire assembly can also be spray-coated with plastic. The laminations themselves are not perforated.

4 Claims, 5 Drawing Figures

SWITCHING MAGNET

This invention relates to a structure for an electromagnetic device particularly useful as a switching magnet.

BACKGROUND OF THE INVENTION

With a known alternating current magnet, a laminated yoke consists of preformed bundles of laminations which are assembled into their final arrangement by rivetting, welding or wedging their position in the assembly. The bundles of laminations are difficult to handle during assembly. Also, laminations which are provided with insulation on their mutually separating surfaces are perforated by the mechanical connection, leading to power losses.

BRIEF DESCRIPTION OF THE INVENTION

An object of the present invention is to provide a switching magnet structure in which the laminated yoke is simple to assemble and wherein the laminations are assembled without breaking through the insulation.

Briefly described, the invention includes an improved switching magnet structure of the type including a yoke, an armature and a coil spool having a hollow cylindrical portion, spaced flange members on the cylindrical portion and a coil wound around the cylindrical portion, wherein the improvement includes a plurality of U-shaped laminations arranged in bundles, each lamination having two legs and an interconnecting portion, the outer corner at the conjunction of each leg with its interconnecting portion being bevelled at an acute angle relative to the leg. Means defining guides slots are formed on the outwardly facing surfaces of the flange members for receiving the leg portions of bundles of the laminations to form the yoke, the slots being axially aligned with each other at opposite ends of the spool. Cover plates are provided in substantially parallel, spaced apart relationship with each other and with the flange members, the cover plates engaging opposite ends of the bundles of laminations thereby forming the yoke, each of the cover plates having contact surfaces positioned to engage the beveled portions of the laminations in the bundles to restrain the bundles against radial outward movement relative to the core spool.

The separate bundles of laminations of the yoke are mounted with the distal ends of the arms facing each other in the guide slots on the coil body and they are held in that radial position by the cover plates. By application of an axial force on the cover plates during the assembly of the structure, the separate bundles of laminations are positioned and clamped radially without the necessity that they be in a certain specific shape before hand. The bundles of laminations are interconnected with each other only by the narrow border of the contact surface, which is also the case with the laminations in each individual bundle thereof. Because of this, only small eddy current losses occur. If the cover plates are solid, heat generated within the switching magnets can be dissipated easily.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
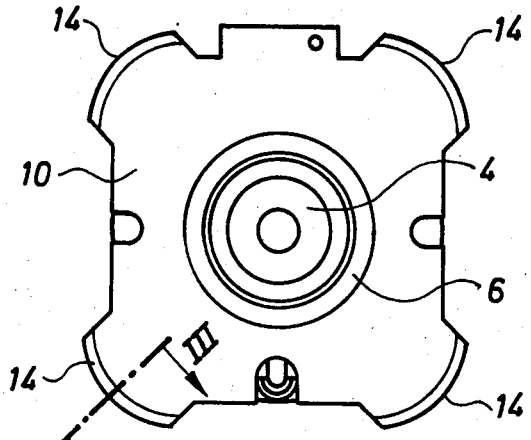
FIG. 1 is a top plan view of a structure in accordance with the present invention.
Figure 2:
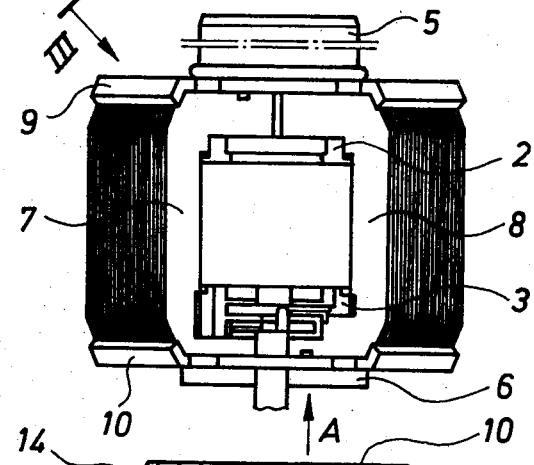
FIG. 2 is side elevation of the apparatus of FIG. 1.
Figure 4:
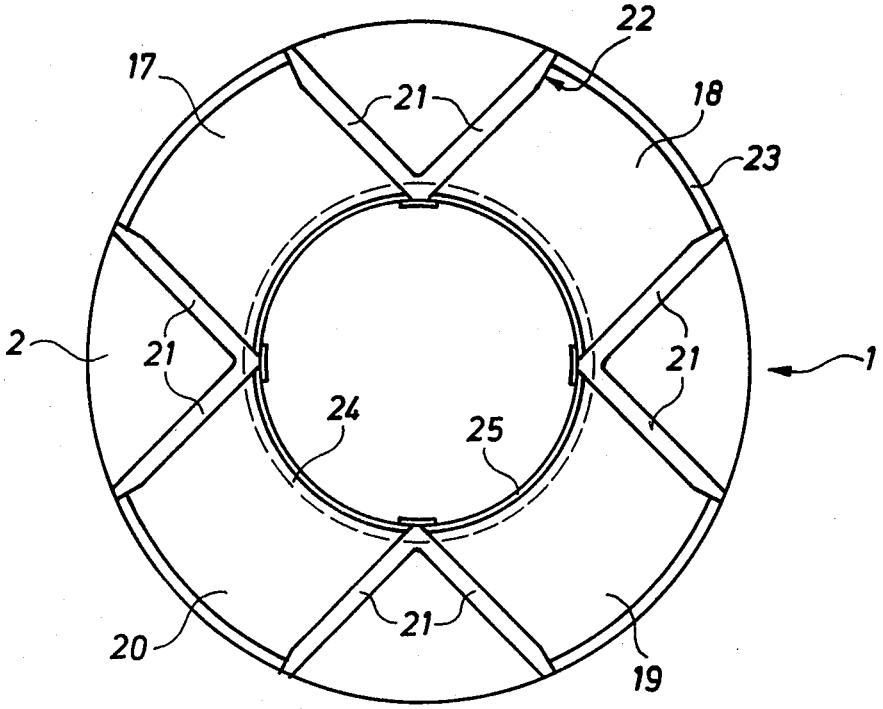
FIG. 4 is an enlarged top plan view of a coil spool usable in connection with the apparatus of FIGS. 1–3.
Figure 5:
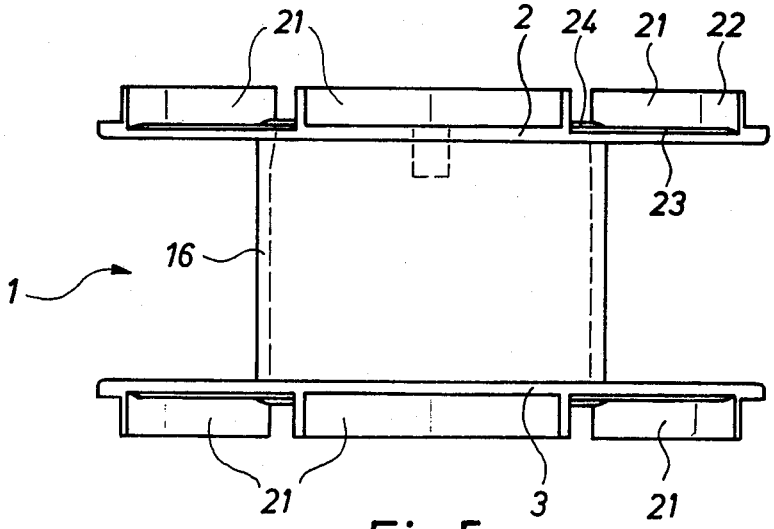
FIG. 5 is a side elevation of the spool of FIG. 4.

Referring now to the drawings in detail, the structure includes an alternating current magnet including a covered coil of wire which is mounted on a coil spool or bobbin 1, the bobbin being shown in FIGS. 4 and 5, having a top flange part 2 and a bottom flange part 3 which can be seen in FIG. 1. The coil spool 1 is interspersed by a pole tube 5 having a pole core 4, the tube having a flange 6 at the bottom thereof as seen in FIGS. 1 and 2. Coil spool 1, flange parts 2 and 3, and pole tube 5 are at least partially surrounded by four bundles of laminations forming a cruciform yoke, only lamination bundles 7 and 8 being visible in FIG. 2. The bundles of laminations are covered on the top and bottom by cover plates 9 and 10. Cover plates 9 and 10 are made of sheet metal and are of essentially identical configuration.

Figure 3:
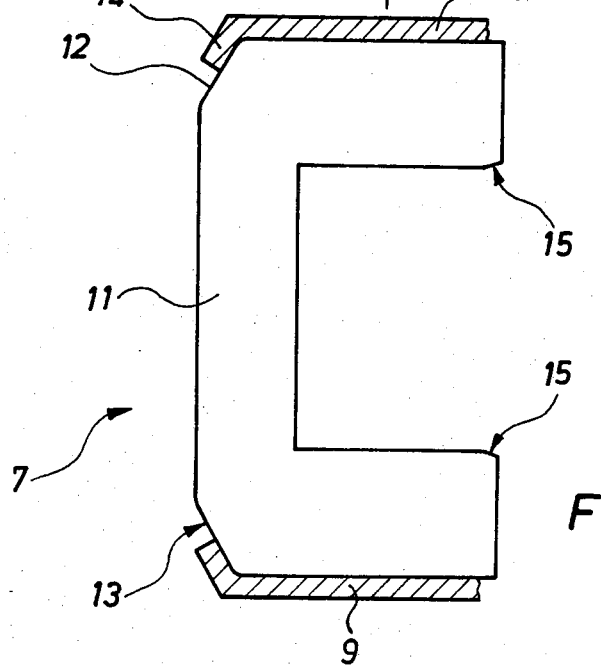
FIG. 3 is a sectional view along III—III of FIG. 1, at an enlarged scale showing the relationship between a lamination and the cover plate.

Each of the bundles of laminations 7 and 8 includes a plurality of U-shaped laminations 11 which are provided with insulation on their major surfaces. It will be observed that each lamination, as illustrated in FIG. 3, includes two legs and an interconnecting portion, and the outer corners of each lamination adjacent the junctions of the legs with the interconnecting portions are beveled at 12 and 13. The beveled edges form an angle of between about 30° and about 60° to the axis of the assembly and those angles are identical. Each of the cover plates 9, 10 has a beveled or inclined contact surface 14 which is shaped to correspond to the beveled corners of the laminations, the contact surfaces 14 being positioned so that they will engage the corners of assembled bunded of laminations in their operative positions.

Laminations 11 also have beveled corners 15 on the inner ends of their arms at those corners which face each other, these bevels 15 making an angle of between about 60° and about 85°, but preferably about 75°, to the axis of the alternating current magnet structure to facilitate easy assembly of the lamination bundles onto the coil spool 1.

Coil spool 1 has a hollow cylindrical part 16 and the two flange parts 2 and 3 which are generally parallel to each other and which are mounted at or near opposite ends of the cylindrical portion. The pole tube 5 is mounted in cylindrical portion 16 and the coil wire is wound around the outside of portion 16 between flanges 2 and 3. The major surface of flanges 2 and 3 which face outwardly, i.e., away from each other, are provided with means defining four intersecting guide slots 17, 18, 19 and 20, these guide slots being arranged so that the slots formed on flange 2 are axially aligned with the slots formed on flange 3. Each pair of the guide slots thus axially aligned receives the legs of a bundle of laminations 7, 8. Guide slots 17–20 are defined by axially protruding ribs 21. These ribs are arranged in pairs, the ribs in each pair being substantially parallel with each other, and, in the embodiment illustrated, the ribs of one pair are perpendicular to the ribs of the next circularly adjacent pair. Each of ribs 21 has a beveled surface 22 near the outer end thereof, serving to widen the radially outer end of the slot defined by the ribs, again to facilitate assembly of the laminations.

The edges of flanges 2 and 3 are also provided with beveled surfaces 23. These bevels also simplify the assembly of the bundles of laminations into the guide slots. Near the radially inner end of each guide slot, adjacent the central opening through which the core extends, the structure is provided with an annular beveled surface 24 which serves as an inner limit for the ends of the legs of the laminations, thereby assisting in positioning and retaining the bundles of laminations 7 or 8. Inside this beveled surface, the edge portion is formed with a step or shoulder 25 for simple installation of the magnetic pole tube.

The laminations of a bundle thereof will thus be seen to be retained on the coil spool 1 by the walls of guide slots 17–20 in peripheral position, by the outer surfaces of flanges 2 and 3 in axial position, and by the contact surfaces 14 of cover plates 9, 10, which are beveled or inclined around their radii.

In the assembly of the cruciform yoke, the four bundles of laminations are separately inserted into guide slots 17–20 radially in their spaced positions around coil spool 1 until they engage beveled surface 24. With that beveled surface limiting the movement thereof, individual laminae of the bundles are prevented from projecting inwardly beyond bevelled surface 24 and the pole tube 5 can be mounted on coil spool 1. Cover plates 9, 10 are then placed on the axial ends, after mounting of the pole tube. The bundles of laminations 7, 8 are retained by action of the cover plates 9, 10 against beveled surfaces 12 and are guided and retained in their working positions.

The alternating current magnet is spray-coated with plastic following the assembly of its individual parts. During the spray-coating process, an axial force is applied to cover plates 9 and 10 and the bundles of lamination 7,8 located between them. As will be recognized, a number of lamination bundles different from 4 can be arranged on a coil spool 1, in which case the guide slots 17–20 would be arranged to retain them in a relationship other than the cruciform arrangement illustrated, but with equiangular distribution of spacing between the bundles.

The structural form described generally suffices for switching magnets which can also be direct current magnets.

While certain advantageous embodiments have been chosen to illustrate the invention it will be understood by those skilled in the art that various changes and modifications can be made therein without departing from the scope of the invention as defined in the appended claims.

What is claimed is:

1. An improved switching magnet structure of the type including a yoke, an armature and a coil spool having a hollow cylindrical portion, spaced flange members on the cylindrical portion and a coil wound around the cylindrical portion, wherein the improvement comprises a plurality of U-shaped laminations arranged in bundles, each said lamination having two legs and an interconnecting portion, the outer corner at the junction of each leg with the interconnecting portion being beveled at an acute angle relative to the leg;

means defining guide slots formed on the outwardly facing surfaces of the flange members for receiving the leg portions of bundles of said laminations to form a yoke, said slots being axially aligned with each other at opposite ends of said spool; and first and second cover plates spaced apart in substantially parallel relationship with each other and with the flange members and engaging the bundles of laminations forming said yoke, each said cover plate having contact surfaces positioned to engage said beveled portions of said laminations in said bundles to restrain said bundles against radial outward movement relative to said core spool.

2. A structure according to claim 1 wherein each said cover plate is formed from sheet metal and said contact surfaces are inclined inwardly to correspond to said beveled portions.

3. A structure according to claim 1 wherein said means defining said guide slits comprises a plurality of ribs protruding axially from the outwardly facing surfaces of the flange portions.

4. A structure according to claims 1, 2 or 3 wherein the cylindrical portion of the coil spool includes, at each end thereof means defining an inclined surface rising radially inwardly and projecting beyond the adjacent flange surface;

the periphery of the outwardly facing surface of each said flange is beveled; and the inwardly facing surfaces of said ribs are beveled at the radially outer ends thereof.

* * * * *